US007377996B2

(12) United States Patent
Bilodeau

(10) Patent No.: US 7,377,996 B2
(45) Date of Patent: May 27, 2008

(54) CARD SHEET WITH STARCH COMPOSITIONS FORMING BREAKABLE LAYERS IN PRE-CUT SUBSTRATES

(75) Inventor: Wayne L. Bilodeau, Mentor, OH (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 11/037,436

(22) Filed: Jan. 18, 2005

(65) Prior Publication Data

US 2005/0161180 A1 Jul. 28, 2005

Related U.S. Application Data

(60) Provisional application No. 60/539,251, filed on Jan. 26, 2004.

(51) Int. Cl.
*G09F 3/00* (2006.01)
*D21H 19/00* (2006.01)

(52) U.S. Cl. ..... 162/136; 162/175; 162/194; 428/43; 428/167; 427/289

(58) Field of Classification Search ..... 162/136, 162/175, 194; 428/43, 167; 427/289
See application file for complete search history.

(56) References Cited

U.S. PATENT DOCUMENTS 4,060,506 A 11/1977 Verganac ..... 260/17.4
4,138,508 A 2/1979 Spatz et al. ..... 427/54
4,838,580 A * 6/1989 Tuhkanen ..... 283/56
4,863,772 A 9/1989 Cross ..... 428/40
4,957,947 A * 9/1990 Chen et al. ..... 522/66
5,003,022 A 3/1991 Nguyen et al. ..... 527/300
5,147,907 A 9/1992 Rinck et al. ..... 524/48
5,262,216 A 11/1993 Popat et al. ..... 428/42

(Continued)

FOREIGN PATENT DOCUMENTS

WO 00/16978 3/2000

(Continued)

OTHER PUBLICATIONS

O.B. Wurzburg, Modified Starches: Properties and Uses, CRC Press, 1986, pp. 122-123, sections 2. Sizing and 3. Coating.*

*Primary Examiner*—Steven P. Griffin
*Assistant Examiner*—Dennis R. Cordray
(74) *Attorney, Agent, or Firm*—SoCal IP Law Group LLP; Douglas N. Larson

(57) ABSTRACT

A card sheet including a top material layer having pre-cut weakened lines extending partially but not completely through the top material layer, the top material layer having a front side and a back side; and a starch composition layer applied to the back side of the top material layer, wherein at least a portion of the starch composition diffuses into the top material layer to a depth and renders the top material layer breakable along the weakened lines. A method of making the card sheet, including providing the top material layer, cutting partially through the top material layer; and applying a starch composition to form the starch composition layer on the back side of the top material layer; and at least partially removing any diluent present in the starch composition. The top material layer may be printable, and the card sheet may include a second top material layer.

39 Claims, 4 Drawing Sheets

U.S. PATENT DOCUMENTS

| | | | | |
|---|---|---|---|---|
| 5,389,414 | A | 2/1995 | Popat | 428/40 |
| 5,416,181 | A | 5/1995 | Nguyen et al. | 527/300 |
| 5,436,073 | A | 7/1995 | Williams et al. | 428/343 |
| 5,462,983 | A | 10/1995 | Bloembergen et al. | 524/51 |
| 5,571,587 | A * | 11/1996 | Bishop et al. | 428/43 |
| 5,580,640 | A | 12/1996 | Kraft et al. | 428/195 |
| 5,662,976 | A | 9/1997 | Popat et al. | 428/40.1 |
| 5,702,789 | A | 12/1997 | Fernandez-Kirchberger et al. | 428/40.1 |
| 5,750,200 | A | 5/1998 | Ogawa et al. | 427/361 |
| 5,800,870 | A | 9/1998 | Luebke et al. | 427/369 |
| 5,853,837 | A | 12/1998 | Popat | 428/43 |
| 5,993,928 | A | 11/1999 | Popat | 428/43 |
| 5,997,680 | A | 12/1999 | Popat | 156/252 |
| 5,997,683 | A | 12/1999 | Popat | 156/277 |
| 6,001,209 | A | 12/1999 | Popat et al. | 156/249 |
| D421,046 | S | 2/2000 | Popat | D19/1 |
| 6,040,379 | A | 3/2000 | Luebke et al. | 524/734 |
| 6,183,844 | B1 * | 2/2001 | Li | 428/32.25 |
| 6,294,237 | B1 | 9/2001 | Popat | 428/40.1 |
| 6,769,718 | B1 * | 8/2004 | Warther et al. | 283/61 |
| 6,773,181 | B2 | 8/2004 | Crum | 400/621 |
| 6,948,742 | B2 | 9/2005 | Buck | 283/56 |
| 2001/0007703 | A1 | 7/2001 | Weirather et al. | 428/42.2 |
| 2001/0024716 | A1 * | 9/2001 | Chen et al. | 428/317.9 |
| 2001/0036525 | A1 | 11/2001 | Yokokawa | 428/43 |
| 2002/0047263 | A1 | 4/2002 | McCarthy et al. | 283/107 |
| 2003/0049404 | A1 | 3/2003 | Mercer et al. | 428/42.3 |
| 2003/0148056 | A1 * | 8/2003 | Utz et al. | 428/43 |
| 2003/0150550 | A1 | 8/2003 | Weirather et al. | 156/248 |
| 2003/0232191 | A1 * | 12/2003 | Ishikawa | 428/343 |
| 2005/0057038 | A1 | 3/2005 | Crum | 283/106 |
| 2005/0058814 | A1 | 3/2005 | Crum | 428/195.1 |
| 2005/0087977 | A1 | 4/2005 | Crum | 283/62 |
| 2005/0106364 | A1 | 5/2005 | Crum | 428/195.1 |
| 2005/0163980 | A1 | 7/2005 | Crum | 428/200 |
| 2005/0200117 | A1 | 9/2005 | Crum | 283/62 |

FOREIGN PATENT DOCUMENTS

| | | |
|---|---|---|
| WO | 00/46316 | 8/2000 |
| WO | 01/76885 A2 | 10/2001 |
| WO | WO 03/043822 A1 * | 5/2003 |

* cited by examiner

Fig. 1
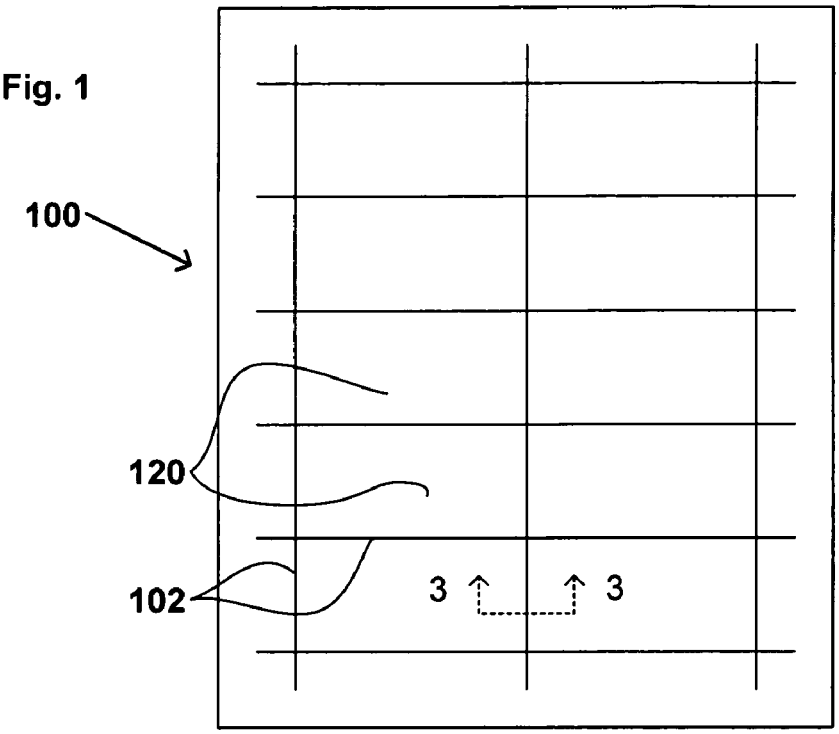
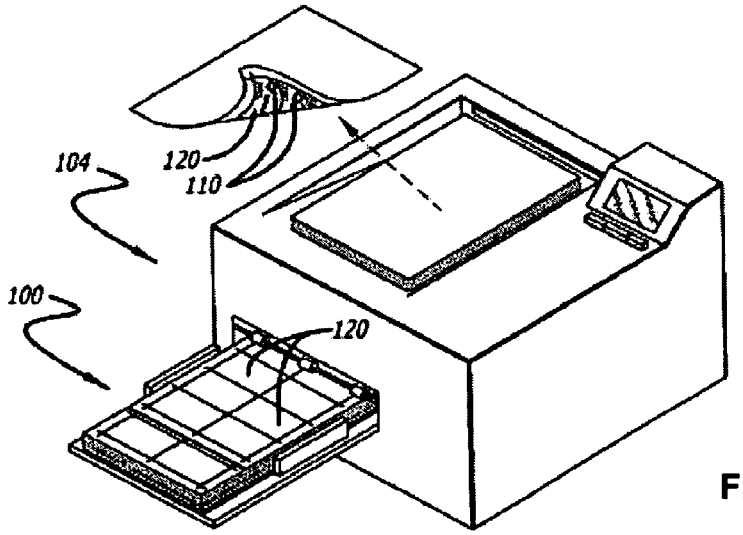
Fig. 2

CARD SHEET WITH STARCH COMPOSITIONS FORMING BREAKABLE LAYERS IN PRE-CUT SUBSTRATES

CROSS-REFERENCE TO RELATED APPLICATION

This application claims the benefit, under 35 U.S.C. §119(e) of U.S. Provisional Application No. 60/539,251, filed 26 Jan. 2004, the entirety of which is incorporated herein by reference.

TECHNICAL FIELD

The present invention relates to sheets of calling or business cards, photograph cards, post cards and the like, methods of making them and methods of using them, from which individual units can be broken out from the sheets.

BACKGROUND

The design of calling or business cards by simply printing them with commercially available laser or inkjet printers is of interest. Small size printable media, such as calling or business cards, cannot be individually printed with conventional laser or inkjet printers due to their small format. For this reason, for printing calling cards by means of a laser printer or an inkjet printer, card sheets are usually initially used, from which the calling cards are separated after having been printed, leaving a residual "matrix" of the card sheet. In these card sheets a supporting structure is provided for the cards and a variety of embodiments are known for such card sheets and carriers. In these card sheets and carriers, a problem which has continued to occur is the residue left at the edge of the cards after they are separated from the card sheet and the other cards. If this problem is avoided by cutting completely through the card sheet prior to printing and separation, the problems of providing a support structure and retaining the nascent cards on the support structure remain.

Thus, a need remains for card stock which is pre-scored or pre-cut and is printable with a laser printer, and which breaks cleanly to yield a card having clean edges free of dangling fibers or other unsightly remnants, and which does not require additional supporting structures to hold the cards together.

SUMMARY

In accordance with one embodiment, the present invention relates to card sheets, from which sub-sheets can be separated by simply breaking them out from the sheet, with the broken-out sub-sheets having smooth edges, and no additional structure is required to retain the cards on the card sheet prior to printing and separation of the individual cards.

In one embodiment, the present invention relates to a card sheet, including a top material layer having pre-cut weakened lines extending partially but not completely through the top material layer, the top material layer having a front side and a back side; a starch composition layer applied to the back side of the top material layer, wherein at least a portion of the starch composition diffuses into the top material layer to a depth and renders the top material layer breakable along the weakened lines. In one embodiment, the top material layer is printable.

In another embodiment, the present invention relates to a method of making a card sheet, including providing a top material layer having a front side and a back side; cutting partially through the top material layer to form weakened lines defining one or more sub-sheets on the card sheet; and applying a starch composition to form a starch composition layer on the back side of the top material layer, the starch composition having a viscosity effective to allow at least a portion of the starch composition to diffuse into the back side of the top material layer to a depth at or near the weakened lines; and at least partially removing any diluent from the starch composition. In one embodiment, the removing renders the top material layer breakable along the weakened lines. The method may also include breaking the card sheet at the weakened lines to remove a sub-sheet therefrom.

In one embodiment, the front and the reverse sides of the card sheet feel substantially the same to the touch. In one embodiment, the card sheet includes a top material having punched or die cut lines, the front of which is printable and on the reverse of which at least one starch-copolymer layer is directly applied.

The starch composition layer of the present invention and the mechanical properties it imparts to the card stock when it diffuses into the card stock allow the card stock to be die cut (or otherwise cut) on the top only, without needing to be pre-cut completely through the card stock. In one embodiment, the starch or starch-copolymer layer and its diffusion into the card stock material allows for a clean snap-break with only a single folding action. In other words, the user does not have to fold it back and forth to break it. As used herein, "snap break" means that the starch composition layer, and the portion of it which is diffused into the card stock, yield during bending to a point, less than fully folded, where the layers suddenly break along the pre-cut weakened lines. The single folding action, for example, can be forward between about forty-five and about one hundred and sixty-five degrees.

Other advantages of the present invention will become more apparent to those persons having ordinary skill in the art to which the present invention pertains from the foregoing description together with the accompanying drawings.

BRIEF DESCRIPTION OF THE DRAWINGS

FIG. 1 is a top plan view of a card sheet in accordance with an embodiment of the present invention;

FIG. 2 is a perspective view of a printer (or copier) showing a stack of card sheets of FIG. 1 being inserted therein and printed;

Figure 3:
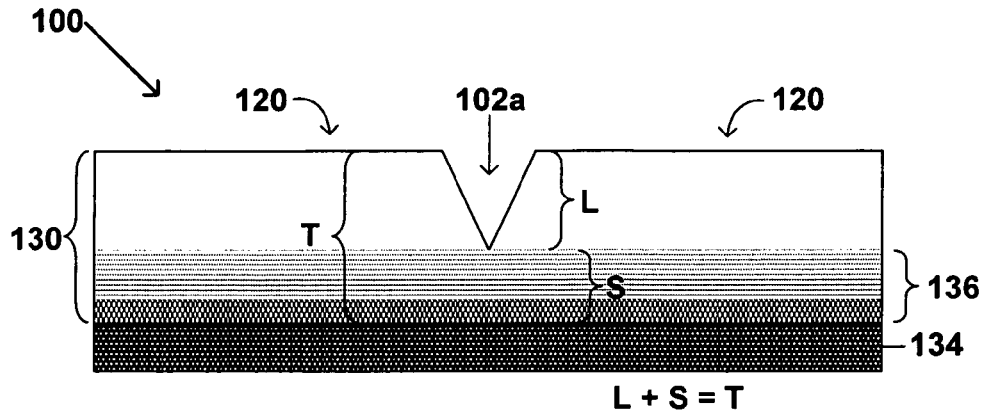
FIG. 3 is an enlarged cross-sectional view of the card sheet of FIG. 1 taken on line 3-3.

It should be appreciated that for simplicity and clarity of illustration, elements shown in the Figures have not necessarily been drawn to scale. For example, the dimensions of some of the elements may be exaggerated relative to each other for clarity. Further, where considered appropriate, reference numerals have been repeated among the Figures to indicate corresponding elements.

It should be appreciated that the process steps and structures described below do not form a complete process flow for preparing cards and card sheet stock or for printing such cards and card sheet stock. The present invention can be practiced in conjunction with evaluation techniques, processing methods and fabrication techniques currently used in the art, and only so much of the commonly practiced process steps and known devices and systems are included as are necessary for an understanding of the present invention.

DETAILED DESCRIPTION

In one embodiment, the card sheet of the present invention includes a top material layer, having a front side and a back side, and pre-cut weakened lines extending partially but not completely through the layer. In one embodiment, the front side of the top material layer is printable. In one embodiment, the card sheet includes a starch composition layer which has been applied to the back side of the top material layer. The starch composition diffuses into the top material layer to a depth and renders the top material layer breakable along the weakened lines. After the starch composition has diffused into the top material layer, it is dried, hardened, cross-linked and/or has a diluent removed and becomes brittle or easily breakable. In one embodiment, removal of any diluent serves to harden the diffused starch composition as well as the starch composition layer. In one embodiment, the diluent is removed by applying heat, which may also be considered heat aging of the starch composition. In one embodiment, the starch composition is hardened to form a brittle, easily breakable layer. In one embodiment, the depth of diffusion is sufficient to provide a clean, substantially residue-free edge when individual cards are subsequently removed from the card sheet.

The starch composition of the present invention may include one or more of a starch, a modified starch, a starch derivative, a starch-copolymer or other known starch compound as defined in more detail hereinbelow, or a mixture of two or more such materials. Thus, the term "starch composition" refers to a composition containing one or a mixture of two or more of the foregoing one or more of a starch, a modified starch, a starch derivative, a starch-copolymer or other known starch compound. The composition may include other materials, such as a diluent (e.g., water, alcohol, etc.) and various additives, also described in more detail below.

A card sheet in accordance with one embodiment of the present invention is shown generally at 100 in FIG. 1. As shown in FIG. 1, the card sheet 100 includes a plurality of pre-cut weakened lines 102 (which may also be referred to as separation lines). The weakened lines 102 define a plurality of individual sub-sheets 120, which can be separated from the card sheet 100 in accordance with the present invention.

As shown in FIG. 2, one or more of the card sheets 100 can be placed in the input tray of a printer (or copier) shown generically at 104. Any desired indicia 110 can be printed on the sub-sheets 120 of the card sheet by the printer (or copier) 104, or by other appropriate printing means. For example, other printing methods, including but not limited to, screen printing, ink-jet printing, flexo printing, gravure printing, thermal transfer printing, direct thermal printing and offset printing.

As shown in cross-sectional view in FIG. 3, the card sheet 100 according to one embodiment of the invention comprises a top material layer 130 and a starch composition layer 134 on a bottom surface of the top material layer 130. A weakened line 102*a* (such as a die-cut line) extends partially through the top material layer 130 to form the perimeters of the nascent individual sub-sheets 120.

As shown in FIG. 3, the top material layer 130 has been cut partially through its thickness, but not completely through to the starch composition layer 134, to form the weakened line 102*a*. In the embodiment shown in FIG. 3, the depth of the weakened line 102*a* is less than the thickness of the top material layer 130. In other embodiments (not shown), the depth of the weakened line may be about equal to the thickness of the top material layer 130. In other embodiments, some of which are shown and discussed below, the depth of the weakened line is less than or equal to the thickness of the top material layer 130. The present invention advantageously provides a mechanism by which individual sub-sheets 120 can be cleanly broken out from the card sheet 100 while still not requiring that the weakened line be cut all the way through the top material layer 130, or in some embodiments, even close to all the way through the top material layer 130.

As shown in FIG. 3, the card sheet 100 includes, in addition to the top material layer 130 and the starch composition layer 134, a region 136 (indicated by brackets) in which the starch composition has diffused to a depth part of the way into the top material layer 130. In one embodiment, the region 136, defined by the depth or distance which the starch composition has diffused into the top material layer 130, has a thickness which is at least equivalent to the uncut thickness of the top material layer 130. FIG. 3 illustrates an embodiment in which the thickness of the region 136 is substantially equivalent to the uncut thickness of the top material layer 130.

The region 136 shown in the drawing figures represents diffusion of the starch composition, originating from the starch composition layer 134, into the top material layer 130. As will be understood, the amount of starch composition penetrating by diffusion into the top material layer 130 would be expected to decrease with increasing depth into the top material layer 130. Thus, the darkness of the shading in the region 136 as shown in FIGS. 3-8 decreases with depth into the top material layer 130 to illustrate schematically the expected corresponding decrease in amount of starch composition diffusing to the depths indicated schematically in the Figures. The illustrated decrease in density of diffused starch composition is intended as illustrative, not as limiting of the scope of the invention.

The depth to which the pre-cut weakened lines are cut may be suitably selected, based on factors such as the expected depth of diffusion of the starch composition into the top material layer, the composition and porosity of the top material layer, the composition of the starch composition, any pressure applied to the starch composition during the application to the top material layer, and other factors known to those in the art.

Figure 4:
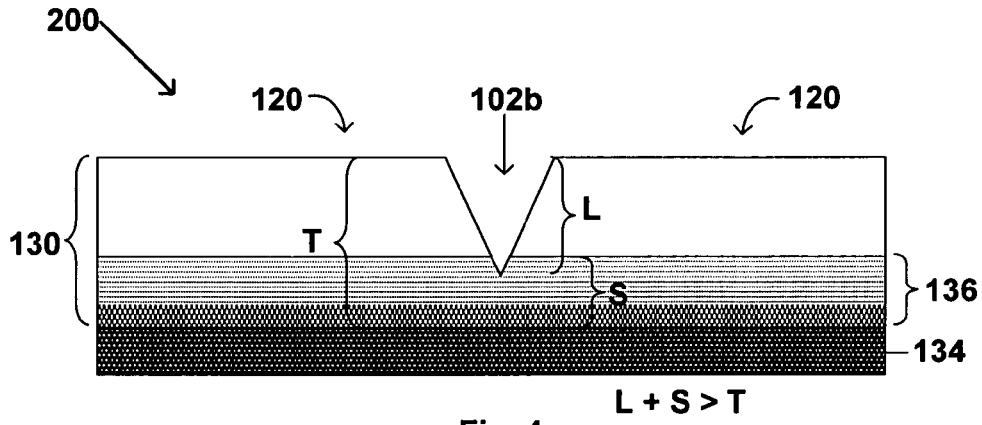
FIG. 4 is an enlarged cross-sectional view of another embodiment of a card sheet similar to that shown in FIG. 3.

As shown in FIG. 4, in one embodiment, while the depth of the weakened line 102*b* is less than the thickness of the entire top material layer 130, the starch composition diffuses into the top material layer 130 to a depth such that the weakened line 102*b* extends into the region 136 in which the starch composition has diffused. Viewed alternatively, as shown in FIG. 4, the starch composition has diffused beyond the depth of the weakened line 102*b*.

Figure 5:
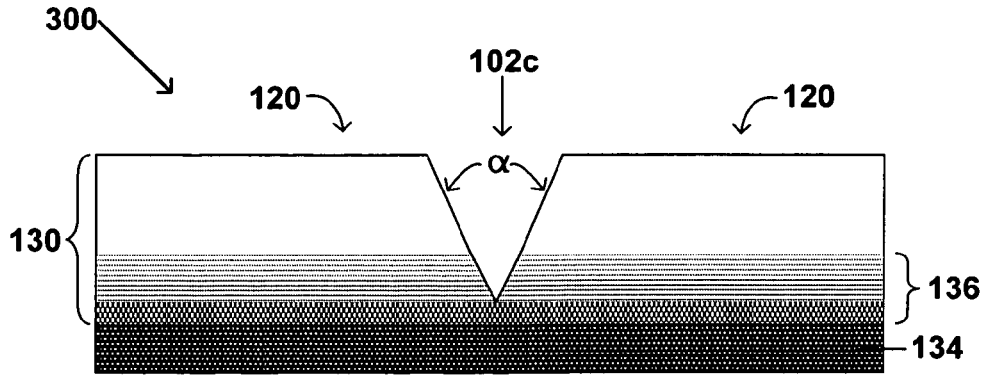
FIG. 5 is an enlarged cross-sectional view of still another embodiment of a card sheet similar to that shown in FIG. 3.

As shown in FIG. 5, in another embodiment, while again the depth of the weakened line 102*c* is less than the thickness of the entire top material layer 130, the starch composition diffuses into the top material layer 130 to a depth such that the weakened line 102*c* penetrates further into the region 136 in which the starch composition has diffused, as compared to the embodiments shown in FIGS. 3 and 4.

Expressed in another way, if the total thickness of the top material layer 130 is "T", the depth of the weakened line 102 is "L", and the depth to which the starch composition diffuses into the top material layer from the bottom side is "S", then in one embodiment, L+S≧T, as shown, for example, in FIGS. 3, 4 and 5. In another embodiment, L+S>T, as shown, for example, in FIGS. 4 and 5. In another embodiment, L+S=T, as shown, for example, in FIG. 3. In another embodiment, L+S≈T. In one embodiment (not shown), L+S<T, but is substantially similar, that is, L+S is only slightly less than T. By slightly less, it is intended that the difference is small enough that the card sheet will break cleanly, leaving little or no roughness along the broken edges.

This diffusion of the starch composition into the top material layer 130 is an important aspect of the present invention, since the presence of the starch composition renders the uncut portion of the top material layer 130 sufficiently brittle to cause the uncut portion to break and separate cleanly when the sub-sheet 120 is removed from the card stock 100, as described below.

In order to separate individual sub-sheets 120 from the card sheet 100, the top material layer 130 has the punched or die cut weakened lines 102*a*, 102*b*, 102*c*, etc., as shown in the drawings. In one embodiment, the starch composition layer 134 is not punched, only a portion of the region 136 is cut or punched. In one embodiment, the punching or die cutting operation forming the weakened lines 102*a* (etc.) may dent or partially cut into but not pass through the starch composition layer. In another embodiment, the punching or die cutting operation forming the lines 102 may penetrate only a slight distance into the starch composition layer 134. The depth to which the pre-cut weakened lines are cut may be suitably selected, based on factors such as the expected depth of diffusion of the starch composition into the top material layer, the composition of the top material layer, the composition of the starch composition, and other factors known to those in the art.

Figure 6A:
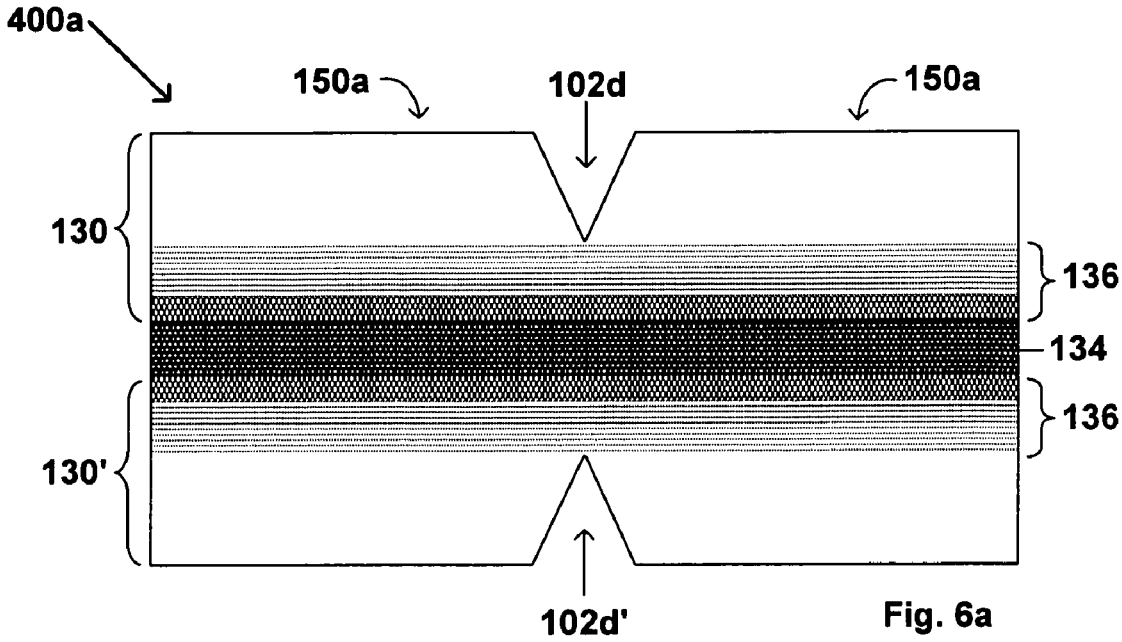
FIGS. 6*a* and 6*b* are enlarged cross-sectional views of two additional embodiments of a card sheet in accordance with the present invention.
Figure 6B:
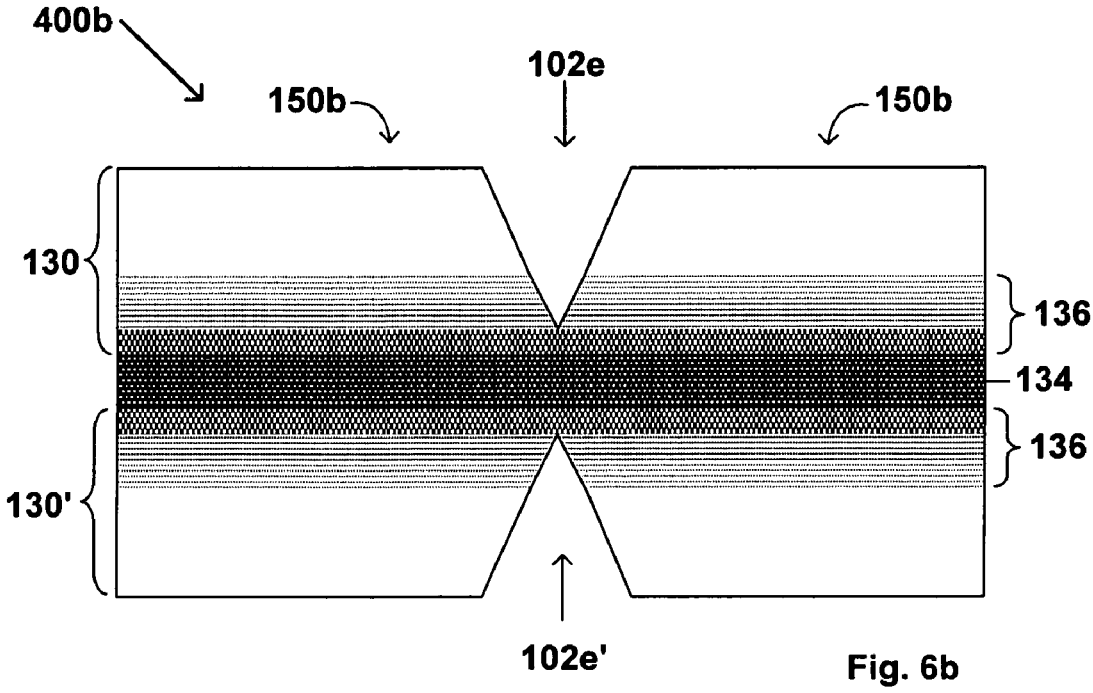

FIGS. 6*a* and 6*b* are enlarged cross-sectional views of two additional embodiments of a card sheet 400*a*, 400*b* in accordance with the present invention. In the embodiments shown in FIGS. 6*a* and 6*b*, a second top material layer 130' has been applied to the starch composition layer 134, in addition to the first top material layer 130. In one embodiment, the second top material layer 130' is printable as is the first top material layer 130.

As shown in FIGS. 6*a* and 6*b*, in these embodiments, the starch composition diffuses into both the first top material layer 130 and the second top material layer 130' in a manner substantially similar to the embodiments shown in FIGS. 3-5, to form a region or regions 136 in each of the top material layers 130 and 130' in which the starch composition has diffused.

As shown in FIG. 6*a*, in this embodiment, both the top material layer 130 and the second top material layer 130' have been cut or punched to form the weakened lines 102*d* and 102*d*'. The depth of the weakened lines 102*d* and 102*d*' in FIG. 6*a* corresponds approximately to those of FIG. 3, that is, the depth of the weakened lines 102*d*, 102*d*' is sufficient to reach the diffusion depth of the region 136 diffused from the starch composition layer 134, but not through the entire thickness of the layers 130, 130'.

As shown in FIG. 6*b*, in this embodiment, both the top material layer 130 and the second top material layer 130' have been cut or punched to form weakened lines 102*e* and 102*e*'. The depth of the weakened lines 102*e* and 102*e*' in FIG. 6*b* corresponds approximately to those of FIG. 5, that is, the depth of the weakened lines 102*e*, 102*e*' is sufficient to penetrate a substantial depth into the region 136 diffused from the starch composition layer 134, but not through the entire thickness of the layers 130, 130'.

As shown in FIGS. 6*a*, 6*b*, when the card sheets 400*a*, 400*b* are broken or separated at the weakened lines 102*d*, 102*d*' and 102*e*, 102*e*', individual sub-sheets 150*a*, 150*b*, each having two top material layers 130, 130' on opposite faces, are obtained. The embodiments of FIGS. 6*a* and 6*b* may have the starch composition diffused into the respective top material layers to form regions 136 having any of the disclosed relationships to either or both the depth of the weakened lines 102*d*, 102*d*' and/or 102*e*, 102*e*' and the thickness of the respective top material layers 130, 130'. The weakened lines 102*d*, 102*d*' and 102*e*, 102*e*' in any embodiment may be the same or different depths. Similarly, the depth or thickness of the regions 136 may be the same or different in each of the top material layer 130 and the second top material layer 130' in any embodiment.

In addition, in any given embodiment, the two top material layers 130, 130' may be the same or different in the embodiments shown in FIGS. 6*a*, 6*b*. The material from which the top material layer 130 and the second top material layer 130' are formed may be appropriately selected from those described herein, based on the needs of the user and the type of sub-sheet 150*a*, 150*b* to be produced. In one embodiment, the second top material layer is paper, as is the top material layer in one embodiment. In one embodiment, both the top material layers are paper.

In one embodiment, the top material layer (or one or both of the first and second top material layers when both are present) is top coated. The top coating may be any appropriate coating, such as a coating which enhances the printability of the coated layer. Suitable top coats can be selected by those of ordinary skill in the art, based upon the desired end use of the card stock. For example, a top coat which increases the "delta gloss" may be used, such as a coating made by blending specialty pigments such as talc or alumina, or specialty binders such as highly carboxylated styrene/butadiene latexes, into a matte coating composition. Another example includes a top coating containing a polyolefin resin and a pigment, for example porous particles of organic pigment material and calcium carbonate particles. Numerous such top coatings are known in the art.

In one embodiment, the top material layer (or one or both of the first and second top material layers when both are present) is a photoreceptive layer. In another embodiment, when both are present, both of the first and second top material layers are photoreceptive layers.

Figure 7A:
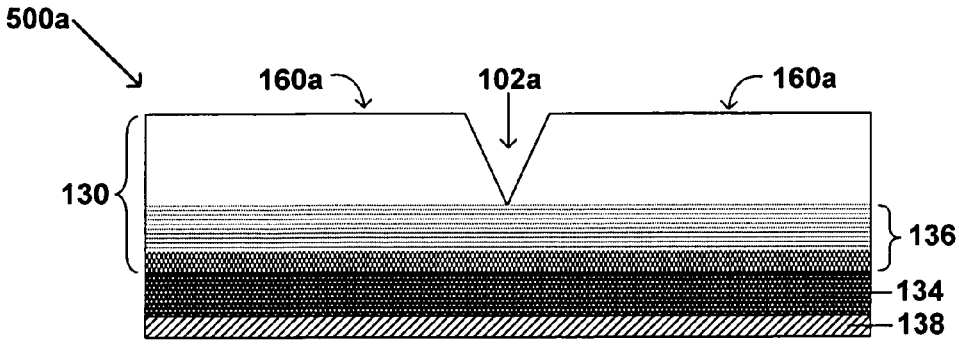
FIGS. 7*a* and 7*b* are enlarged cross-sectional views of two further embodiments of a card sheet in accordance with the present invention.
Figure 7B:
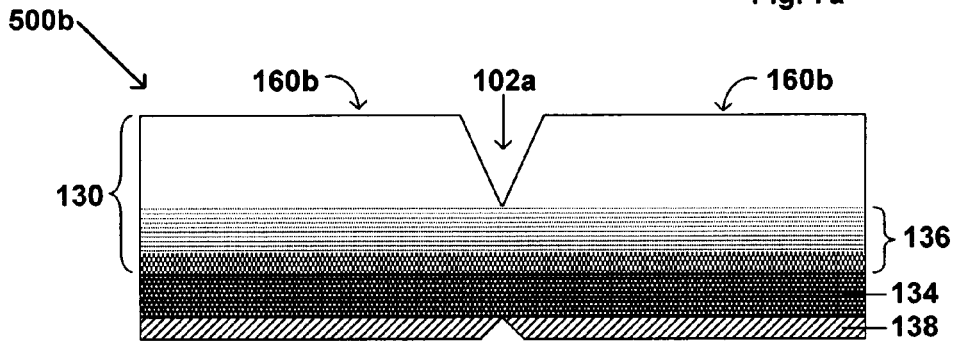

FIGS. 7*a* and 7*b* are enlarged cross-sectional views of two further embodiments of card sheets 500*a*, 500*b* in accordance with the present invention. In the embodiments shown in FIGS. 7*a* and 7*b*, an additional layer 138 has been applied to the starch composition layer 134. In the embodiment shown in FIG. 7*a*, the additional layer 138 is applied over the bottom or lower surface of the card sheet 500*a*, and is not cut or scored. In this embodiment, the additional layer 138 may be formed of a material which is sufficiently brittle to break or separate together with the starch composition layer 134 when it is broken during the separation process. In the embodiment shown in FIG. 7*b*, the additional layer 138 is applied over the bottom or lower surface of the card sheet 500*b*, and is cut or scored, to ease or enhance the separation process. In an embodiment such as shown in FIG. 7*b*, the additional layer 138 may be formed of any material, brittle or not brittle, since it is cut or scored to ease or enhance the separation process.

In one embodiment, the additional layer 138 is a printable layer, formed from any material known in the art to be receptive to printing, whether by ink jet, laser printing, or any other known printing method. For example, in one embodiment, the additional layer 138 may be a common inkjet coating for films, which allows printing with an inkjet printer. Such inkjet coatings are known to persons of ordinary skill in the art. In one exemplary embodiment, the inkjet coating includes one or more latex binders (e.g., vinyl acetate, ethylene vinyl acetate), one or more fixing agents (e.g., polyamine) and silica. In one embodiment, the layer 138 may be a top coat, as described above. The additional layer 138 may be applied by any appropriate method.

In another embodiment, the additional layer 138 may comprise a polymeric material, such as a polyolefin or polyester. In one embodiment, the additional layer may comprise an adhesive material, such as a pressure-sensitive adhesive.

In one embodiment, the step of applying includes coating a pre-polymer mixture on the back side of the starch layer and curing the mixture. The coating a pre-polymer on the back side of the starch layer, in one embodiment, is carried out after the starch composition has been diffused into the paper layer, and in one embodiment, after the starch composition has been dried.

In one embodiment, the curing of the pre-polymer mixture includes irradiating the pre-polymer mixture with UV light or with an electron beam. In one embodiment, the pre-polymer mixture includes a photoinitiator. As is known, a photoinitiator is not required with electron beam curing.

In another embodiment, the curing of the pre-polymer mixture includes thermal curing. In one embodiment, the pre-polymer mixture includes a thermal initiator.

In one embodiment, to provide a starch composition layer for sub-sheets pre-cut or punched (etc.) in the card sheets 100, 200, 300, 400 and 500, the starch composition layer 134 is applied directly onto the reverse side of the top material layer 130 such as by doctor blade coating, etc. In one embodiment, when the top material layer 130 has a weight of about 120 to about 300 g/m$^2$, the starch composition layer 134 applied thereto has a weight of about 10 to about 75 g/m$^2$. In another embodiment, when the top material layer 130 has a weight of about 150 to about 275 g/m$^2$, the starch composition layer 134 applied thereto has a weight of about 15 to about 60 g/m$^2$. In another embodiment, when the top material layer 130 has a weight of about 160 to about 250 g/m$^2$, the starch composition layer 134 applied thereto has a weight of about 20 to about 50 g/m$^2$.

The separation of the individual sub-sheets 120 from the card sheet 100 of the invention may be carried out by bending along the punched lines 102, 102*a*-102*e* in the direction toward the top material layer 130, whereby the starch composition layer 134 snap-breaks cleanly along the punched lines 102, 102*a*-*e*. For this purpose, in one embodiment, the starch composition layer is brittle, in that it breaks cleanly and sharply without a significant amount of elongation or stretching and without leaving dangling fibers or a rough or uneven edge.

In one embodiment, the elongation at break of the starch composition layer 134 should be exceeded; that is, the elastic and plastic deformation of the starch composition layer 134 should be as small as possible. In addition, the starch composition layer should have resistance to tearing. In other words, it should be brittle, so that when one side of the starch composition layer is subjected to tension exceeding its elongation at break, the break will continue to the side that is not bent. In one embodiment, the starch composition layer 134 on the back side of the top material layer 130 has a stress-at-break in the range of about 10 to about 50 MPa, in one embodiment about 15 to about 25 MPa. In one embodiment, the starch composition has an elongation at break in the range of about 5 to about 120%, and in one embodiment, from about 20 to about 50%. The data on stress-at-break and elongation at break refer to EN-ISO 527-3/2/500.

In one embodiment, the elongation at break of the starch or starch copolymer layer 134 further depends on the thickness of the top material layer 130. In this embodiment, the thicker the top material layer 130, the less the elongation of the starch composition layer 134 is and the sooner the stress-at-break of the polymer layer 134 is attained. The aforementioned weights of the top material layer 130 may be appropriate for this embodiment.

The starch composition of the starch composition layer 134 applied to the reverse or back side of the card sheet 100 in one embodiment has a bending stress in the range of about 200 to 1200 MPa, and in another embodiment, a bending stress of about 400 to 900 MPa. In one embodiment, the starch composition has an elongation at maximum tensile strength from about 2 to about 10 percent. In one embodiment, the card sheet has a bending stress in the range of about 600 to about 1200 MPa. The bending stress is determined according to EN-ISO 178.

The individual sub-sheets 120 broken out of the card sheets 100, 200, 300, 400, 500, according to the invention, may be constructed and used as calling (business) cards, photograph cards, post cards or the like as would be apparent to those skilled in the art from this disclosure. Various length and width dimensions may be selected according to the desired use, and the present invention is not limited to any particular sizes. For example, sub-sheet sizes such as 2×3.5 inches for business cards, 4×6, 5×7, 2×3 and 8×10 may be appropriate for photocards. The card sheet itself can, for example, be "letter" size (8½×11 in. or 21.6×27.94 cm), "legal" size (8½×14 in. or 21.6×35.56 cm) or A4 size (8.27×11.69 in. or 21×29.7 cm). These card sheet sizes are exemplary only, and are compatible with standard sized printers and copiers, but any other size may be used.

In one embodiment, the top material layer 130 can have a thickness from about 120 μm to about 300 μm and in another embodiment from about 150 μm to about 250 μm. While the lower limit is important for the breaking behavior (for very brittle starch composition layers, thinner and less stiff materials are acceptable), the upper limit is important for the desired total thickness of the product.

In one embodiment, thickness of the starch composition layer 134 ranges from about 10 to about 75 g/m$^2$, or 10 to about 75 μm. In one embodiment, thickness of the starch composition layer 134 ranges from about 20 to about 60 g/m$^2$, or 20 to about 60 μm.

Figure 8A:
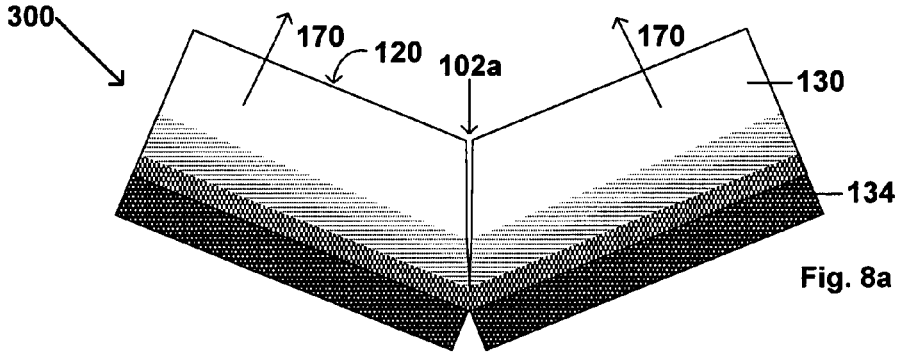
FIGS. 8*a* and 8*b* show the snap-break mechanism of a card sheet in accordance with an embodiment of the invention similar to that shown in FIG. 5.
Figure 8B:
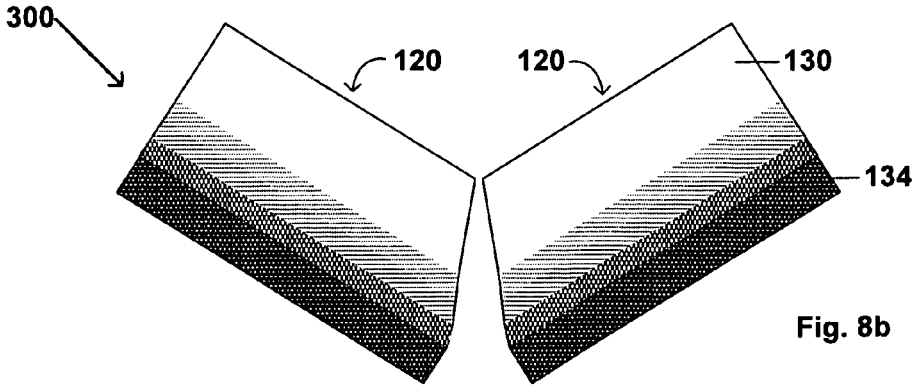

The mechanism for breaking a card sheet of the present invention is illustrated in FIGS. 8*a* and 8*b*, using the embodiment of the card sheet shown in FIG. 5. As described above, FIG. 5 shows a cross-section of a portion of a card sheet 300 in accordance with an embodiment of the present invention. In one embodiment, the card sheet has been passed through a printer (or copier) 104 and the desired indicia printed on the upper surface of the top material layer 130. A V-shaped die cut 102*c* is illustrated in FIG. 5 through a portion, but not all, of the top material layer 130 and into the region 136, but not to the starch composition layer 134. The die cut 102*c* is illustrated to have an angle α wherein, in one embodiment, α is from about 40 to about 80 degrees, and in one embodiment α is from about 50 to about 75 degrees, and in one embodiment α is about 60 degrees.

As shown in FIG. 8*a*, to separate the Individual sub-sheets 120 from the rest of the sheet 300, the sheet is fokied upwards or towards the top material layer 130 and about the weakened line 102c, as shown by arrows 170. The bottom layer 134, as is schematically illustrated in FIG. 8*a*, in one embodiment begins to break when the sheet 300 is bent, and breaks along a clean straight line beneath (adjacent) the die cut line. As shown in FIG. 8*b*, the remainder of the sheet 300 breaks in a clean straight line due to the embrittlement of the material due to the presence of the starch composition in the region 136 of the top material layer 130. In other words, in one embodiment, with only a single fold the sheet 300 snap breaks cleanly to free the sub-sheet 120.

While the breaking is illustrated in FIGS. 8*a* and 8*b* using the embodiment of FIG. 5, the same basic mechanism applies to each of the other embodiments of the present invention.

In one embodiment, the top material layer (or layers) is printable. A "printable top material layer" means materials that can be printed with an inkjet printer and/or a laser printer 104 or other commercial printing methods such as offset printing, and/or by writing instruments. Writing instruments can include, for example, pens, pencils or the like. As the top material layer 130 or 130', generally any card stock materials may be used which can be printed with an inkjet printer and/or a laser printer 104. Such card stock materials can, for example, also be coated or uncoated, dull or glossy, marmorated or obliquely transparent or they can have a linen or other topographic structure. When the individual sub-sheets 120 are to be calling or business cards, in one embodiment, a card stock material having a weight of about 150 to about 250 g/m$^2$ may be used. Examples of useful card stock materials include matte coated paper available from Felix Schoeller Specialty Papers (Osnabruck, Germany) and photoreceptive papers from Kanzaki Specialty Papers (Springfield Mass.); as well as laser papers available from Kohler (Germany), Neusiedler Group (Austria), and Monadnock Paper Mills (New Hampshire). In one embodiment, the card stock is a 10 point ink-jet cardstock made by Monadnock Paper. The papers, when used in conjunction with the starch composition layer, have a caliper suitable for the desired use, such as business or photo cards.

Starch and Starch Copolymers

Generally, any of a variety of starches, modified starches, starch derivatives or starch copolymers may be suitable for use in forming the starch composition layer 134, as long as the layer obtains the mechanical properties indicated herein. The term "starch", as used herein, encompasses both natural and synthetic starches, modified starches, starch derivatives and starch copolymers, and mixtures thereof.

Starch $(C_6H_{10}O_5)n$ is a mixture of linear (amylose) and branched (amylopectin) polymers having the following general structure:

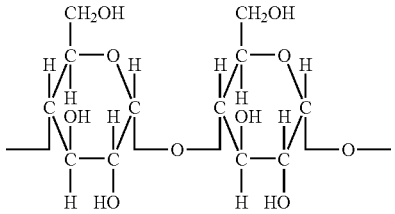

Amylose is essentially a linear polymer of α(1→4) linked D-glucopyranosyl units. Amylopectin is a highly-branched polymer of D-glucopyranosyl units containing α(1→4) linkages, with α(1→6) linkages at the branch points. The most common starches are corn starch and potato starch. The starch compositions of the present invention can include various types of starches, such as regular corn starch which contains about 75% amylopectin (higher molecular weight branched starch polymer) and 25% amylose (lower molecular weight linear starch polymer), as well as hybrid corn starch products containing more than 50% amylose, sold by National Starch and Chemical Company Corporation and American Maize Products Company. Various other starches, such as potato starch, tapioca starch, rice starch, wheat starch, cassava starch, guar, and other starches familiar to those skilled in the art can be utilized in accordance with the present invention. For example, amylopectin derivatives or isomers having different branch points may be included within the scope of starch.

In one embodiment, the starch composition includes a modified starch, which is defined as any of several water-soluble polymers derived from a starch (e.g. corn, potato, tapioca) by acetylation, chlorination, acid hydrolysis, or enzymatic action. These reactions yield starch acetates, esters, and ethers in the form of stable and fluid solutions and films. Thin-boiling starches have high gel strength, oxidized starches made with sodium hypochlorite have low gelling tendency. Introduction of carboxyl, sulfonate, or sulfate groups into starch gives sodium or ammonium salts of anionic starches, yielding clear, non-gelling dispersions of high viscosity. Cationic starches result from addition of amino groups.

The glucose units of starch can be crosslinked with such agents as formaldehyde, soluble metaphosphates, and epichlorohydrin; this increases viscosity and thickening power. In addition, the glucose units of starch can be crosslinked by various organic monomers, such as the synthetic, functional olefinic monomers described below.

Starch materials useful according to the present invention include practically all starches of plant origin including starches from corn, wheat, potatoes, tapioca, rice, sago and sorghum. As used herein "starch" refers to starch, modified starch, starch derivatives and starch copolymers, and mixtures of two or more thereof, as indicated above.

Suitable starch derivatives include those wherein the starch is a starch derivative modified by acid hydrolysis, enzymolysis, oxidation, or sonication. Suitable functional derivative groups include alkyl, alkenyl, aryl, arylalkyl, arylalkenyl, cycloalkyl, and cycloalkenyl ethers, hydroxyethers, esters including organic acid esters, amides, ketones, acetals, and ketals, and derivatives thereof, carboxylates, phosphates, sulfates, sulfonates, amino, and quaternary ammonium groups, and combinations thereof.

In one embodiment, the starches may be thinned starches. Waxy and high amylose starches may also be suitable. The starches may be thinned by acid hydrolysis, oxidative hydrolysis or enzymatic degradation. By the term "thinned starch," it is contemplated that thin natural polysaccharide materials such as dextrins, maltodextrins, chemically substituted maltodextrins and enzyme thinned maltodextrins may be useful with the present invention. Thinned derivatized starches are also suitable for practice of the invention. Suitable starch derivatives include those such as starch ethers, starch esters, cross-linked starches, oxidized starches and chlorinated starches as noted above.

Starch derivatives include, for example, hydroxyalkyl starch ethers, including hydroxyethyl and hydroxypropyl starch ethers and enzyme thinned hydroxyethyl starch ethers. In one embodiment, the starch derivative is a thin, lightly oxidized hydroxyethyl corn starch ether available commercially as Pencote®(Penford Products, Inc., Cedar Rapids, Iowa).

In one embodiment, the starch composition comprises a starch/latex copolymer, such as Pen CP, available from Penford Products, Inc. In one embodiment, PenCP 318 starch copolymer, from Penford is used. In one embodiment, the starch/latex copolymer is applied to a card sheet at a weight in a range from about 15 to about 50 grams per square meter ($g/m^2$), and in another embodiment from about 20 to about 40 $g/m^2$, and in one embodiment from about 25 to about 30 $g/m^2$ and in one embodiment, about 26 $g/m^2$.

In another embodiment, the starch composition comprises an underivatized enzyme thinned starch which can be produced from an unmodified corn starch slurry having a solids content, in one embodiment, of between about 10% and about 45% and in another embodiment, between about 35% and about 45%.

In one embodiment, the starch composition comprises a graft copolymer including a starch and vinyl monomers including 1,3-butadiene, such as disclosed in U.S. Pat. No. 5,003,022, the disclosure of which is incorporated herein by reference for its teachings relating to graft copolymers of starches and vinyl monomers. U.S. Pat. No. 5,003,022 discloses a graft copolymer made from an aqueous polymeric dispersion comprising a graft copolymer of thinned, gelatinized starch and one or more vinyl grafting monomers, the vinyl monomers including at least 10% by weight 1,3-butadiene. In one embodiment, the stable aqueous dispersion is generally characterized by a solids content of at least 20% by weight. In another embodiment, the solids content is at least 30% by weight and in another embodiment, above 45% by weight. The dispersion has a viscosity of generally at least 50 cps, and in one embodiment, the viscosity is less than 10,000 cps, in another embodiment less than about 2,000 cps and in another embodiment less than about 1,000 cps.

The starch for use in preparing the graft copolymers may include any of those disclosed above for use as the starch, or derivatives thereof, as also disclosed above.

Suitable vinyl monomers, for use either with the 1,3-butadiene in forming graft copolymers such as disclosed in U.S. Pat. No. 5,003,022, or for cross-linking the glucose moieties of the starch, include isoprene, chloroprene, cyclobutadiene and divinyl benzene. Suitable vinyl monomers which can be co-grafted with 1,3-butadiene, or used to cross-link the starch, include alkyl acrylates, hydroxylated alkyl acrylates, alkyl methacrylates, hydroxylated alkyl methacrylates, alkyl vinyl ketones, substituted acrylamides, methacrylic acid, crotonic acid, itaconic acid, fumaric acid, maleic acid, maleic anhydride, vinyl halides, vinylidene halides, vinyl esters, vinyl ethers, vinyl carbazole, N-vinyl pyrrolidone, vinyl pyridine, chlorostyrene, alkyl styrene, ethylene, propylene, isobutylene, vinyl triethoxy silane, vinyl diethylmethyl silane, vinyl methyl dichloro silane, triphenyl vinyl silane, and 1-vinyl-1-methylsila-14-crown-5 and mixtures thereof.

In forming the graft copolymers, suitable chain transfer agents and initiators may be used as needed. Suitable chain transfer agents include materials such as n-dodecyl mercaptan, n-cetyl mercaptan, bromoform, carbon tetrachloride and the like in amounts ranging from 0.01 to about 5 percent of the monomer weight, or in one embodiment, from about 0.10 to about 1% of the monomer weight. Suitable initiators include organic and inorganic peroxy compounds, azo compounds and persulfate compounds. In one embodiment, hydrogen peroxide or persulfate ion free radical initiators are used, and in one embodiment potassium persulfate is used. Persulfates may be used in amounts of at least about 0.1% of the weight of monomers used, but is preferably used in a range of from about 1% to about 10%. The persulfate initiator may be used alone or in a mixture with other oxidants. In addition to the foregoing, surfactants may also be added to stabilize the grafted starch dispersion. Suitable surfactants include anionic, cationic, amphoteric and nonionic.

The graft copolymers of U.S. Pat. No. 5,003,022 can be prepared as described therein in detail. In general, the starches are gelatinized by cooking at a solids content of between 20 and 40% (dry basis). The cooked, gelatinized, thinned starch paste is then placed in a reaction vessel capable of containing and withstanding the pressure of the reaction. Because of the relatively high volatility of 1,3-butadiene, it is grafted under pressure. In general, the more 1,3-butadiene present in the reaction mixture, the higher the pressure at which the reaction is run. Maximum pressures during the reaction are generally between about 25 and about 300 psig (about 172 KPa to about 2068 KPa), with maximum pressures usually in a range of 40 to 70 psig (about 276 KPa to about 483 KPa). The initiators, chain transfer agents, surfactants and any other ingredients can be added as appropriate, as described in U.S. Pat. No. 5,003,022.

In one embodiment, starch esters may be used. Starch esters may be more hydrophobic than non-esterified starches, and so in one embodiment, may be used to adjust the hydrophilic/hydrophobic nature of the starch or starch-copolymer layer 134. Starch esters may be considered to be a specialty starch, and may have an amylose content greater than 50% and in some embodiments greater than 70% amylose content. The degree of substitution in one embodiment ranges from about 0.4 to about 2.5 DS and in another embodiment from about 1.0 to about 2.0 DS, and in yet another embodiment, from about 1.2 to about 1.7 DS. Lower degrees of substitution and smaller organic acid moieties may be expected to be more hydrophilic and higher degrees of substitution and larger organic acid moieties may be expected to be more hydrophobic.

The degree of substitution (DS) of a starch is the (average) number of substituent groups attached per glucose or other sugar unit. The term is used mainly in cellulose chemistry where each glucose unit has three reactive (hydroxyl) groups. The DS can range from zero (starch itself) to three (fully substituted or derivatized starch).

The aforementioned starches can be made into a wide range of starch esters using a wide variety of anhydrides, organic acids, acid chlorides, ketene, or other esterification reagents. Examples of anhydrides include acetic-, propionic-, butyric-, maleic-, succinic-, phthalic- and stearic anhydride anhydrides and combinations thereof to derive copolymer derivatives. Such starch esters can be made in accordance with U.S. Pat. No. 5,869,647 and by other known methods. Other methods exist and can be developed for making such starch ester products.

In one embodiment, the starch composition is a starch copolymer such as that prepared by the methods described in U.S. Pat. No. 6,040,379, the disclosure of which is incorporated herein by reference for its teachings relating to starch copolymers and methods of making the same.

Starches and starch derivatives suitable for use in the process as described in U.S. Pat. No. 6,040,379 may be derived from any botanical source, such as corn or maize, potato, tapioca, banana, wheat, rice, amaranth, and sorghum, as described above in more detail. In one embodiment, the starch is derivatized by the introduction of functional groups and the molecular weight modified to a specified range.

The starch molecular weight may be modified by any known method, such as acid hydrolysis, enzymolysis, oxidation, or sonication, or combinations thereof. Typical reagents used include the mineral acids, α-amylase, alkali and alkaline earth hypochlorites, peroxydisulfates and permanganates, organic peroxides, hydroperoxides, and the like. Preferred reagents include hydrochloric and sulfuric acids, α-amylase, sodium hypochlorite, calcium hypochlorite, ammonium peroxydisulfate, sodium peroxydisulfate and potassium peroxydisulfate.

Synthetic monomers useful for forming the starch copolymers according to the methods of U.S. Pat. No. 6,040,379 include α-olefins, conjugated and nonconjugated dienes, vinyl aromatic compounds, acrylic acid, methacrylic acid, itaconic acid, $C_1$ to $C_{18}$ esters of acrylic, methacrylic, and itaconic acid, behenyl ethoxyl methacrylate, vinyl esters of $C_1$ to $C_{18}$ organic acids, acrylonitrile, acrylamide, and $C_1$ to $C_{18}$ N-substituted and N,N-disubstituted acrylamides, and methacrylamidoethylethyleneurea. Additional examples include, but are not limited to, styrene, p-methylstyrene, p-t-butylstyrene, p-methoxystyrene, vinyl toluene, vinyl naphthalene, and divinyl benzene; isobutylene, 4-methyl-1-pentene, 1,3-butadiene, 2-methyl-1,3-butadiene, 1,4-hexadiene, and 5-ethylidene-2-norbornene; acrylic acid, methacrylic acid, itaconic, acid, and their $C_1$ to $C_{18}$ alkyl, cycloalkyl, alkenyl, aryl, arylalkyl, and arylalkenyl esters; methyl acrylate, ethyl acrylate, n-butyl acrylate, isobutyl acrylate, 2-ethylhexyl acrylate, methyl methacrylate, ethyl methacrylate, isobutyl methacrylate, isobornyl methacrylate, phenyl methacrylate, lauryl methacrylate, behenyl ethoxyl methacrylate, ethylene glycol diacrylate and ethylene glycol dimethacrylate; the $C_1$ to $C_{18}$ alkyl esters of maleic and fumaric acids; acrylonitrile; vinyl acetate, vinyl butyrate, vinyl stearate, and sodium vinyl sulfonate; methyl vinyl ether, ethyl vinyl ether, and isobutyl vinyl ether; methyl vinyl ketone; acrylamide, N-methylacrylamide, N,N-dimethylacrylamide, N-t-butylacrylamide, N-t-octylacrylamide, and N-methylolacrylamide, methacrylamidoethylethyleneurea, vinyl chloride, vinylidene chloride, vinyltrimethylsilane, m-isopropylidene-dimethylbenzyl isocyanate, and the like, and mixtures thereof.

The amount of vinyl monomers used relative to the starch may vary from about 5 parts by weight (pbw) monomers to 95 pbw starch to as high as about 98 pbw monomers to 2 pbw starch. In one embodiment, the monomer to starch ratio is in the range of about 20:80 to about 98:2, and in another embodiment, from about 40:60 to about 95:5 parts by weight.

Free radicals to initiate the polymerization of these monomers may be generated by many techniques, including the thermal and induced decomposition of precursor species, ionizing radiation, ultrasound, and the like, and combinations thereof. In one embodiment, the free radicals are generated by the thermal or induced decomposition of free radical-generating precursor species, hereinafter referred to as initiators. Initiators may be of the water-soluble or oil-soluble types, and may include hydrogen peroxide, organic peroxides, hydroperoxides, peroxyacids, peroxyesters, peroxydicarbonates, peroxydisulfates, azonitriles, halogens and halocarbons. Various specific examples are provided in U.S. Pat. No. 6,040,379, which has been incorporated by reference herein.

In one embodiment, the starch copolymer may be derived from a starch acrylamide such as those disclosed in U.S. Pat. No. 4,060,506, the disclosure of which relating to starch acrylamides is incorporated herein by reference. The starch acrylamides of this embodiment include starches having pendant and terminal acrylamide groups and having a general structure depicted as:

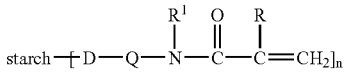

in which "starch" represents a starch chain, as defined herein, R and $R^1$ independently are H or a monovalent organic group, Q is an organic group divalently linking the D group with the acrylamide moiety, and D is S or O, and n is the number of acrylamide groups per glucose unit of the starch molecule, which is also referred to as degree of substitution, or "DS", and may range from about 0.1 to about 3.

The divalent organic group Q may be, for example, substituted or unsubstituted straight or branched aliphatic groups (e.g., alkylene), substituted or unsubstituted arylene group (e.g., naphthalene, phenylene, etc.) as well as divalent organo groups which contain carbon to non-carbon atom linkages (e.g., organo ethers and thioethers, sulfonyl, N-methylene substituted secondary and tertiary amines such as a —$CH_2$—N(H)-Q- radical. The Q group linking chain may contain carbonyl, carbonylhydroxy, thiocarbonyl, etc. groups as well as monovalent substituents such as hydroxy, halo, (e.g., Br., F, Cl and I), alkyl, aryl, hydroxyalkyl, hydroxyaryl, alkoxy, aryloxy, carboxyalkyl, carboxyaryl, amine substituents, combinations thereof and the like. In one embodiment, divalent organo group Q contains less than 10 carbon atoms and in one embodiment no more than 7 carbon atoms.

The R and $R^1$ mono-organo group may contain an ester, ether, carboxylic, organo acid, alcohol, hydrocarbyl (e.g., alkyl, aryl, phenyl, etc.) groups as well as divalent organo groups containing non-carbon atom to carbon chain linkages (e.g., such as the oxy, sulfonyl, thio, carbonyl groups, etc. as mentioned above with respect to Q).

Under free-radical initiating polymerization conditions (e.g., thermal or irradiation induction), the starch acrylamides interpolymerize to form starch interpolymerizates containing recurring interpolymerized units. In one embodiment, the individual appendant acrylamide groups will have a molecular weight of less than 400 and in one embodiment between about 100 to about 200. In general a greater number of different starch chains are interpolymerized and linked together via interpolymerized acrylamide (including other ethylenically unsaturated monomers when present in the interpolymerizate reaction) as "a" or the acrylamide DS increases. The degree of interpolymerized acrylamide units in the interpolymerizate is controllable by the DS of the starch acrylamide. As the acrylamide DS increases above 1.0, the starch acrylamides tend to form interpolymerizates of a more rigid and brittle structure. The brittle nature of these starch acrylamides makes these preparations useful for the starch composition layer of the present invention.

In one embodiment, the starch or starch-copolymer comprises a starch or a starch derivative having one or more functional derivative groups selected from alkyl, alkenyl, aryl, arylalkyl, arylalkenyl, cycloalkyl, and cycloalkenyl ethers, hydroxyethers, esters including organic acid esters, amides, ketones, acetals, and ketals, and derivatives thereof, carboxylates, phosphates, sulfates, sulfonates, amino, and quaternary ammonium groups, and combinations thereof.

In one embodiment, the functional group is one or more selected from benzyl, allyl, hydroxyethyl, hydroxypropyl, hydroxybutyl, and 2-hydroxy-3-butenyl ethers, formate, acetate, propionate, butyrate, dodecanoate, and stearate esters, alkenyl succinate esters, carboxylic acid, carboxymethyl, and carboxyethyl derivatives, and combinations thereof.

In one embodiment, the starch-copolymer comprises a monomer selected from α-olefins, conjugated and nonconjugated dienes, vinyl aromatic compounds, acrylic acid, methacrylic acid, itaconic acid, $C_1$ to $C_{18}$ esters of acrylic, methacrylic, and itaconic acid, behenyl ethoxyl methacrylate, vinyl esters of $C_1$ to $C_{18}$ organic acids, acrylonitrile, acrylamide, and $C_1$ to $C_{18}$ N-substituted and N,N-disubstituted acrylamides, and methacrylamidoethylethyleneurea.

In one embodiment, the present invention relates to a method of making a card sheet, including steps of providing a top material layer having a front side and a back side; cutting partially through the top material layer; and applying a starch composition to form a starch composition layer on the back side of the top material layer, the starch composition having a viscosity effective to allow at least a portion of the starch composition to diffuse into the back side of the top material layer to a depth at or near the weakened lines; and at least partially removing any diluent present in the starch composition. In one embodiment, removing the diluent results in at least partially crystallizing the starch composition.

The starch composition may be applied to the top material layer 130 of the card stock by any appropriate method known in the art. Techniques conventional in the industry for applying such coatings to a substrate can be used, such as roll coating, knife over roll coating, and extrusion or slot coating. In addition, doctor blade, trailing edge coater, roller, brush, spray may be used.

The starch composition may include one or more diluents such as water, alcohols or organic solvents to adjust and control the viscosity of the starch composition.

In one embodiment, the method further includes heating or heat aging the starch composition layer, to promote drying, solvent removal, cross-linking and/or crystallization of the starch composition. The heated or heat aged starch composition has increased brittleness of the layer into which the starch composition diffuses, thereby making it easier for the card sheet to break cleanly along the weakened lines.

In one embodiment, the step of applying the starch composition includes extrusion coating the starch composition and then heat aging the coating formed thereby. The heat aging promotes crystallization of the starch composition, as noted above.

In one embodiment, the starch composition is a relatively low viscosity liquid so that the starch composition may be readily diffused into the card stock when applied as a coating to the substrate. In one embodiment, the viscosity of the starch composition is sufficiently low to enhance the diffusion of the starch composition layer into the card stock or substrate. In one embodiment, the starch composition may have a viscosity at 25° C. of from about 0.2 to about 1000 mPa·s. In another embodiment, the starch composition has a viscosity at 25° C. of from about 0.5 to about 100 mPa·s. In yet another embodiment, the starch composition has a viscosity at 25° C. of about 1 to about 50 mPa·s.

To form an embodiment such as that shown in FIGS. 6*a* and 6*b*, the starch composition may be applied either to only one or to both of the top material layers 130, after which the two top material layers 130 can be laminated to each other to form a structure similar to that shown in FIGS. 6*a* and 6*b*.

The steps of the method may be carried out in any appropriate order. In all embodiments, the weakened line 102 may be cut into the top material layer 130 at any appropriate time. Thus, in one embodiment, the weakened line may be formed in the top material prior to application of the starch composition thereto, and in another embodiment, the weakened line may be formed in the top material layer at a time subsequent to application of the starch composition thereto.

While the invention has been explained in relation to various of its embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A card sheet comprising:

a top material layer having a front side and a back side a brittle, starch composition layer on the back side;

the starch composition layer having a thickness greater than 10 μm;

the top material layer including a starch diffusion region extending from the back side and the starch composition layer part way to the front side;

die outlines in the top material layer engaging the front side and extending into the starch diffusion region and spaced from the starch composition layer by a portion of the starch diffusion region;

the die cut lines defining a plurality of sub-sheets;

the front side being printable by a printer or copier; and the card sheet having elongation-at-break and stress-at-break properties such that after the card sheet has been passed through the printer or copier and a printing operation conducted on the front side, the card sheet with only a single forward fold cleanly snap breaks the starch composition layer and the starch diffusion region portion along one of the die cut lines.

2. The card sheet of claim 1 wherein the starch composition of the starch composition layer comprises one or more of (a) a starch-latex copolymer, (b) a starch derivative having one or more functional groups selected from alkyl, alkenyl, aryl, arylalkyl, arylalkenyl, cycloalkyl, and cycloalkenyl ethers, hydroxyethers, esters including organic acid esters, amides, ketones, acetals, and ketals, and derivatives thereof, carboxylates, phosphates, sulfates, sulfonates, amino, and quaternary ammonium groups, and combinations thereof, and (c) a starch-copolymer comprising one or more monomeric unit selected from α-olefins, conjugated and nonconjugated dienes, vinyl aromatic compounds, acrylic acid, methacrylic acid, itaconic acid, $C_1$ to $C_{18}$ esters of acrylic, methacrylic, and itaconic acid, behenyl ethoxyl methacrylate, vinyl esters of $C_1$ to $C_{18}$ organic acids, acrylonitrile, acrylamide, and $C_1$ to $C_{18}$ N-substituted and N,N-disubstituted acrylamides, and methacrylamidoethylethyleneurea.

3. The card sheet of claim 2 wherein the functional group in (b) is one or more of (i) one or more ether selected from benzyl, allyl, hydroxyethyl, hydroxypropyl, hydroxybutyl, and 2-hydroxy-3-butenyl ethers; (ii) one or more ester selected from formate, acetate, propionate, butyrate, dodecanoate, and stearate esters;

or (iii) alkenyl succinate esters, a carboxylic, a carboxymethyl, and a carboxyethyl derivative.

4. The card sheet of claim 1 wherein the card sheet at the die cut lines has a stress-at-break according to EN-ISO 527-3/2/500 in the range of about 10 to about 50 MPa and an elongation-at-break according to EN-ISO 527-3/2/500 in the range of about 10 to about 120%.

5. The card sheet of claim 1 wherein the card sheet at the die cut Fines has a bending stress according to EN-ISO 178 in the range of about 200 to about 1200 MPa.

6. The card sheet of claim 1 wherein the top material layer is paper.

7. The card sheet of claim 1 wherein the top material layer is top coated.

8. The card sheet of claim 1 wherein the top material layer comprises a photoreceptive layer.

9. The card sheet of claim 1 wherein the top material layer can be written upon with a writing instrument.

10. The card sheet of claim 1 wherein the starch composition of the starch composition layer has a viscosity at 25 degrees C. of from about 0.2 to about 1000 mPa-s.

11. The card sheet of claim 1 wherein the starch composition in the starch diffusion layer is at least partially crystallized.

12. The card sheet of claim 1 wherein the starch composition layer has a thickness less than about 37 μm.

13. The card sheet of claim 1 wherein the starch composition layer has a thickness of about 20 μm.

14. The card sheet of claim 1 wherein the starch composition layer has a thickness of about 20 μm to about 60 μm.

15. The card sheet of claim 1 wherein the top material layer has a thickness of between about 120 μm to about 300 μm.

16. The card sheet of claim 1 wherein the top material layer has a thickness of about 150 μm to about 250 μm.

17. A method of forming a card sheet, comprising:

die cutting lines through a front side of a top material layer and a distance partially through the top material layer;

applying a starch composition on the back side of the top material layer to form a brittle, starch composition layer on the back side and a starch diffusion region extending into the top material layer;

the lines extending into the starch diffusion region and spaced from the starch composition layer by a portion of the starch diffusion region;

the starch composition layer having a thickness greater than 10 μm;

the lines defining a plurality of sub-sheets;

the front side being printable by a printer or copier; and the card sheet formed at least in substantial part by the top material layer and the starch composition layer having elongation-at-break and stress-at-break properties such that the sheet with only a single forward fold cleanly snap breaks the starch composition layer and the starch diffusion region portion along one of the lines.

18. The method of claim 17 wherein the die cutting is after the applying.

19. The method of claim 17 further comprising removing diluent from the starch composition.

20. The method of claim 19 wherein the removing includes heat aging the starch composition.

21. The method of claim 19 wherein the applying includes extrusion coating the starch composition.

22. The method of claim 19 wherein the removing at least partially crystallizes the starch composition.

23. The method of claim 17 wherein the applying includes the starch composition having a viscosity sufficient to allow a portion of the starch composition to diffuse into the back side of the top material layer to the lines.

24. The method of claim 17 further comprising single forward folding the sheet on the one of the lines to cleanly snap break the sheet along the one of the lines.

25. The method of claim 17 wherein the top material layer is a cardstock.

26. The method of claim 17 wherein the front side of the top material layer has a photoreceptive surface.

27. The method of claim 17 wherein the top material layer is top coated.

28. The method of claim 17 wherein the applying includes applying the starch composition to the back side of the top material layer and heating the starch composition layer to at least partially remove any diluent present.

29. The method of claim 17 further comprising coating a pre-polymer mixture on a back side of the starch composition layer.

30. The method of claim 29 further comprising curing the mixture.

31. The method of claim 30 wherein the curing comprises (a) curing by irradiating the pre-polymer mixture with UV light, (b) thermally curing, (c) electron beam curing or a combination of two or more of (a), (b) and (c).

32. The method of claim 30 wherein the curing includes irradiating the pre-polymer mixture with UV light.

33. The method of claim 30 wherein the curing includes thermal curing.

34. The method of claim 30 wherein the curing includes electron beam curing.

35. The method of claim 30 wherein the pre-polymer mixture includes a photoinitiator.

36. The method of claim 30 wherein the pre-polymer mixture includes a thermal initiator.

37. The method of claim 29 wherein the starch composition comprises one or more of (a) a starch-latex copolymer, (b) a starch derivative having one or more functional groups selected from alkyl, alkerryl, aryl, arylalkyl, arylalkenyl, cycloalkyl, and cycloalkenyl ethers, hydroxyothers, esters including organic acid esters, amides, ketones, acetals, and ketals, and derivatives thereof, carboxylates, phosphates, sulfates, sulfonates, amino, and quaternary ammonium groups, and combinations thereof, and (c) a starch-copolymer comprising one or more monomeric unit selected from α-olefins, conjugated and nonconjugated dienes, vinyl aromatic compounds, acrylic acid, methacrylic acid, itaconic acid, $C_1$ to $C_{18}$ esters of acrylic, methacrylic, and itaconic acid, behenyl ethoxyl methacrylate, vinyl esters of $C_1$ to $C_{18}$ organic acids, acrylonitrile, acrylamide, and $C_1$ to $C_{18}$ N-substituted and N,N-disubstituted acrylamides, and methacrylamidoethylethyleneurea.

38. The method of claim 37 wherein the functional group in (b) is one or more of (i) one or more ether selected from benzyl, allyl, hydroxyethyl, hydroxypropyl, hydroxybutyl, and 2-hydroxy-3-butenyl ethers; (ii) one or more ester selected from formate, acetate, propionate, butyrate, dodecanoate; or (iii) stearate esters, alkenyl succinate esters, a carboxylic, a carboxymethyl, and a carboxyethyl derivative.

39. The method of claim 17 wherein the applying includes extrusion coating the starch composition.

* * * * *